US011439199B2

(12) United States Patent
Schulten et al.

(10) Patent No.: US 11,439,199 B2
(45) Date of Patent: Sep. 13, 2022

(54) FOOTWEAR SOLE ASSEMBLY

(71) Applicant: Wolverine Outdoors, Inc., Rockford, MI (US)

(72) Inventors: Louk B.J.A. Schulten, Rockford, MI (US); Martin W.F. Dean, Hemel Hempstead (GB)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 16/657,162

(22) Filed: Oct. 18, 2019

(65) Prior Publication Data

US 2021/0112918 A1 Apr. 22, 2021

(51) Int. Cl.
*A43B 13/18* (2006.01)
*A43B 13/12* (2006.01)

(52) U.S. Cl.
CPC ..... *A43B 13/186* (2013.01); *A43B 13/122* (2013.01); *A43B 13/187* (2013.01)

(58) Field of Classification Search
CPC ... A43B 13/122; A43B 13/125; A43B 13/186; A43B 13/187; A43B 13/188; A43B 3/244; A43B 3/246; A43C 15/00; A43C 15/02; A43C 19/00
See application file for complete search history.

(56) References Cited

U.S. PATENT DOCUMENTS 5,657,556 A * 8/1997 Bemis ..... A43B 13/12 12/142 P
5,692,319 A * 12/1997 Parker ..... A43B 7/1495 36/114
7,290,357 B2 * 11/2007 McDonald ..... A43B 5/06 36/102
7,607,241 B2 * 10/2009 McDonald ..... A43B 13/16 36/102
7,647,709 B2 * 1/2010 Reilly ..... A43B 7/1495 36/30 R
10,959,485 B2 * 3/2021 Bathum ..... A43B 3/108
2005/0262739 A1 * 12/2005 McDonald ..... A43B 5/06 36/102
2005/0268491 A1 * 12/2005 McDonald ..... A43B 3/246 36/28

(Continued)

*Primary Examiner* — Khoa D Huynh
*Assistant Examiner* — Haley A Smith
(74) *Attorney, Agent, or Firm* — Warner Norcross + Judd LLP

(57) ABSTRACT

A sole assembly for an article of footwear having a cushioning sole and a support frame fitted about the cushioning sole. The cushioning sole defines the primary ground-engaging surface. The support frame is substantially harder than the cushioning sole. In one embodiment, the support frame includes a perimeter member extending about the perimeter of the cushioning sole, a rear lateral support member disposed toward the forward extent of the heel region and a forward lateral support member disposed in the forefoot region. The cushioning sole may include a support frame recess configured to seat the support frame. The frame recess may include a plurality of channel set into the face of the cushioning sole to recess the support frame from the outer surface. The support frame may include a pair of post that extend through and are affixed to the top surface of the cushioning sole.

18 Claims, 7 Drawing Sheets

(56) References Cited

U.S. PATENT DOCUMENTS

| | | | | |
|---|---|---|---|---|
| 2006/0277798 | A1* | 12/2006 | Reilly | A43B 7/144 36/76 HH |
| 2010/0175280 | A1* | 7/2010 | Rinehart, Jr. | A43B 3/0047 36/59 C |
| 2013/0118037 | A1* | 5/2013 | Bathum | A43B 9/18 36/103 |
| 2014/0182169 | A1* | 7/2014 | Mack | A43B 13/125 36/102 |
| 2016/0242506 | A1* | 8/2016 | Kim | B29D 35/122 |
| 2017/0340056 | A1* | 11/2017 | Bunnell | A43B 13/16 |

* cited by examiner

FOOTWEAR SOLE ASSEMBLY

BACKGROUND OF THE INVENTION

The present invention relates to footwear, and more particularly to a sole assembly for an article of footwear.

Footwear is available in a wide variety of constructions. A typical article of footwear includes a sole joined with an upper. Generally, the sole is configured to form a ground engaging structure that underlies and protects the wearer's foot and the upper is configured to receive and retain the wearer's foot with respect to the sole. The design and configuration of the upper varies with the intended function of the article of footwear.

A wide range of sole constructions are available that provide generally adequate cushioning, support and traction for the foot under a variety of conditions, e.g., walking, running, hiking or standing, or a combination thereof. However, there is an ongoing effort to develop new and improved sole constructions that provide optimal performance across various applications. More specifically, it is common to vary the design and configuration of the sole to match the intended application for the article of footwear. For example, in some applications, the sole is a unitary construction formed from a relatively soft cushioning material. Soles of this construction can provide enhanced cushioning, but typically suffer from premature wear and do not provide adequate support for many applications. As another example, a number of conventional soles are manufactured from an assembly of different materials selected to provide specific functionality. To provide enhanced performance, many soles combine a relatively soft midsole layer that underlies the upper with a relatively hard outsole than extends along the bottom surface of the midsole to provide the ground-engaging structure. The midsole material is typically softer being selected to provide enhanced cushioning, while the outsole material is typically harder being selected to provide enhanced durability and wear resistance. In common applications, the outsole material covers all or substantially all of the ground engaging surface of the sole. While constructions of this type can improve wear resistance and enhance traction, the extensive use of outsole material not only increases weight, but also can negatively affect flexibility. Further, a single external layer of outsole material does little to support the foot—let alone provide varying support characteristics in different regions of the sole assembly.

Despite ongoing efforts, there remains a need for a sole assembly that provides both enhanced comfort and a region-specific support profile, while at the same time remaining relatively light-weight and inexpensive.

SUMMARY OF THE INVENTION

The present invention provides an article of footwear having a sole assembly including a cushioning sole fitted with a support frame. The cushioning sole is manufactured from a relatively soft material that provides enhanced cushioning while the support frame is manufactured from a relatively hard material that selectively supports and reinforces the cushioning sole. The cushioning sole includes a ground-engaging bottom surface and defines a frame recess configured to receive and retain the support frame.

In one embodiment, the support frame include a peripheral member extending around the periphery of the cushioning sole. The peripheral member may be affixed to the sidewall of the cushioning sole near its uppermost extent.

In one embodiment, the cushioning sole includes a peripheral recess. The peripheral recess may be defined in the sidewall and may extend entirely around the periphery of the cushioning sole. The peripheral member of the support frame may be closely fitted into the peripheral recess.

In one embodiment, the support frame includes a longitudinal member extending longitudinally along at least a portion of the length of the sole. The longitudinal member may extend from the peripheral member in the heel of the sole along at least a portion of the ground-engaging surface. In one embodiment, the longitudinal member may extend from the peripheral member in the heel to a location approximate under the ball of the foot.

In one embodiment, the support frame includes at least one lateral member extending laterally across the cushioning sole. The at least one lateral member may bridge the peripheral member. The support frame may include two lateral members—a rear lateral member extending laterally across the cushioning sole in the heel or arch region and a forward lateral member extending laterally across the cushioning sole in the forefoot region. In one embodiment, the rear lateral member and the forward lateral member bridge the peripheral member.

In one embodiment, the frame recess includes a plurality of bottom channels in the face of the ground-engaging surface. The bottom channels may be of sufficient depth to recess the support frame into the bottom surface of the cushioning sole away from the ground-engaging surface. In one embodiment, the bottom channels includes a longitudinal channel receiving the longitudinal member. In one embodiment, the bottom channels include a rear lateral channel receiving the rear lateral member. In one embodiment, the bottom channels include a forward lateral channel receiving the forward lateral member.

In one embodiment, the support frame is secured to the cushioning sole by adhesive. Adhesive may be applied over the entire interface between the support frame and the cushioning sole.

In one embodiment, the peripheral member of the support frame is secured to the cushioning sole by stitching. For example, a line of stitching may be sewn through the peripheral member and the cushioning sole around the perimeter of the sole. The peripheral member may define a stitch groove configured to receive the stitching.

In one embodiment, the support frame includes at least one post extending substantially vertically through a hole defined in the cushioning sole. The post may be secured to the top surface of the cushioning sole to resist separation of the support frame from the cushioning sole. The post may include one or more flaps that are secured to the top surface of the cushioning sole by adhesive. In one embodiment, the support frame includes two posts—a rear post disposed at the intersection of the rear lateral member and the longitudinal member and a forward post disposed at the intersection of the forward lateral member and the longitudinal member.

The present invention provides a sole assembly that combines enhanced overall cushioning with selective support. The support frame includes support members configured to provide region specific support to the cushioning sole without unduly affecting weight or unnecessarily diminishing the cushioning of the cushioning sole. Because the support frame is recessed, the cushioning sole forms the primary ground-engaging surface and is generally free to undergo initial compression without interference from the support frame. As a result, the vertical cushioning properties of the sole assembly are largely dictated by the material properties of the cushioning sole. The support frame provides the sole assembly with support in the lateral and longitudinal directions. For example, the perimeter member of the support frame provides peripheral support for the upper portion of the cushioning sole. The longitudinal support member provides longitudinal support for the cushioning sole. The lateral support members provide lateral support at selected locations. For example, the rear lateral support provides lateral support in the heel region or arch region and the forward lateral support provide lateral support in the forefoot region.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Figure 1:
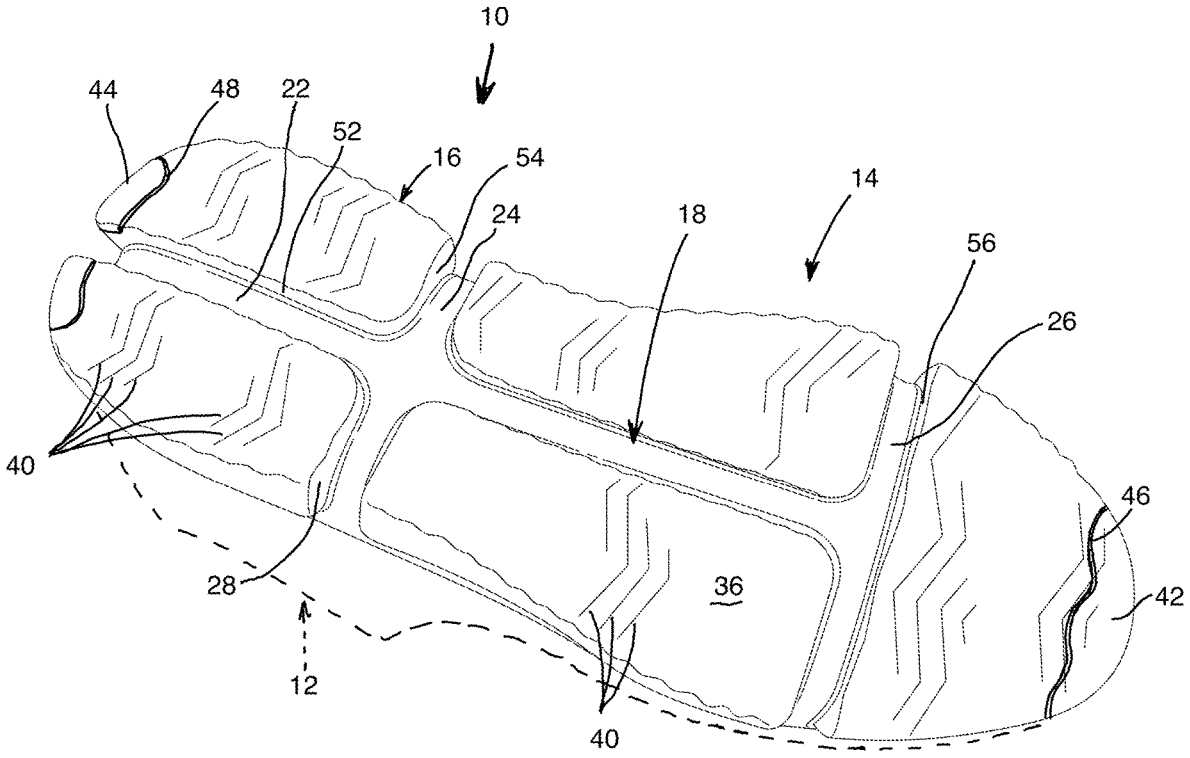
FIG. 1 is a bottom perspective view of an article of footwear having a sole assembly in accordance with an embodiment of the present invention.

An article of footwear having a sole assembly in accordance with an embodiment of the present invention is shown in FIG. 1, and generally designated 10. The article of footwear 10 (or just "footwear") generally includes an upper 12 and a sole assembly 14. In this embodiment, the upper 12 is generally conventional and defines a space that receives a person's foot and holds the foot in position with respect to the sole assembly 14. The sole assembly 14 includes a cushioning sole 16 and a support frame 18. The cushioning sole 16 forms the primary ground-engaging surface of the sole assembly 14. The cushioning sole 16 is manufactured from a relatively soft material capable of providing enhanced cushioning. The support frame 18 is fitted onto the cushioning sole 16 and includes an arrangement of support members that are configured to provide selective support for the cushioning sole 16. The support frame 18 is manufactured from a material that is substantially harder than the cushioning sole 16. In the illustrated embodiment, the support frame 18 includes a perimeter member 20, a longitudinal member 22, a rear lateral member 24 and a forward lateral member 26. In the illustrated embodiment, the cushioning sole 16 defines a support frame recess 28 into which the support frame 18 is seated in a position offset from the ground-engaging surface. As a result, the vertical cushioning properties of the sole assembly 14 are largely dictated by the cushioning sole 16 with the support frame 18 helping to provide lateral and longitudinal support.

A sole assembly 14 in accordance with the present invention may be joined to essentially any type of footwear upper. Although the current embodiment of footwear 10 is illustrated in the context of a casual shoe, it may be incorporated into any type or style of footwear, including hiking shoes, trail boots, hiking boots, work boots, all-terrain shoes, barefoot running shoes, athletic shoes, running shoes, performance shoes, sneakers, conventional tennis shoes, walking shoes, multisport footwear, boots, dress shoes or any other type of footwear or footwear components.

Directional terms, such as "vertical," "horizontal," "top," "bottom," "upper," "lower," "inner," "inwardly," "outer", "outwardly," "below" and "above" are used to assist in describing the embodiments based on the orientation of the embodiments shown in the illustrations. Further, the terms "medial," "lateral" and "longitudinal" are used in the manner commonly used in connection with footwear. For example, when used in referring to a side of the footwear, the term "medial" refers to the inward side (that is, the side facing the other shoe) and "lateral" refers to the outward side. When used in referring to a direction, the term "longitudinal direction" refers to a direction generally extending along the length of the footwear between toe and heel, and the term "lateral direction" refers to a direction generally extending across the width of the footwear between the medial and lateral sides of the footwear. The use of directional terms should not be interpreted to limit the invention to any specific orientation.

Figure 3:
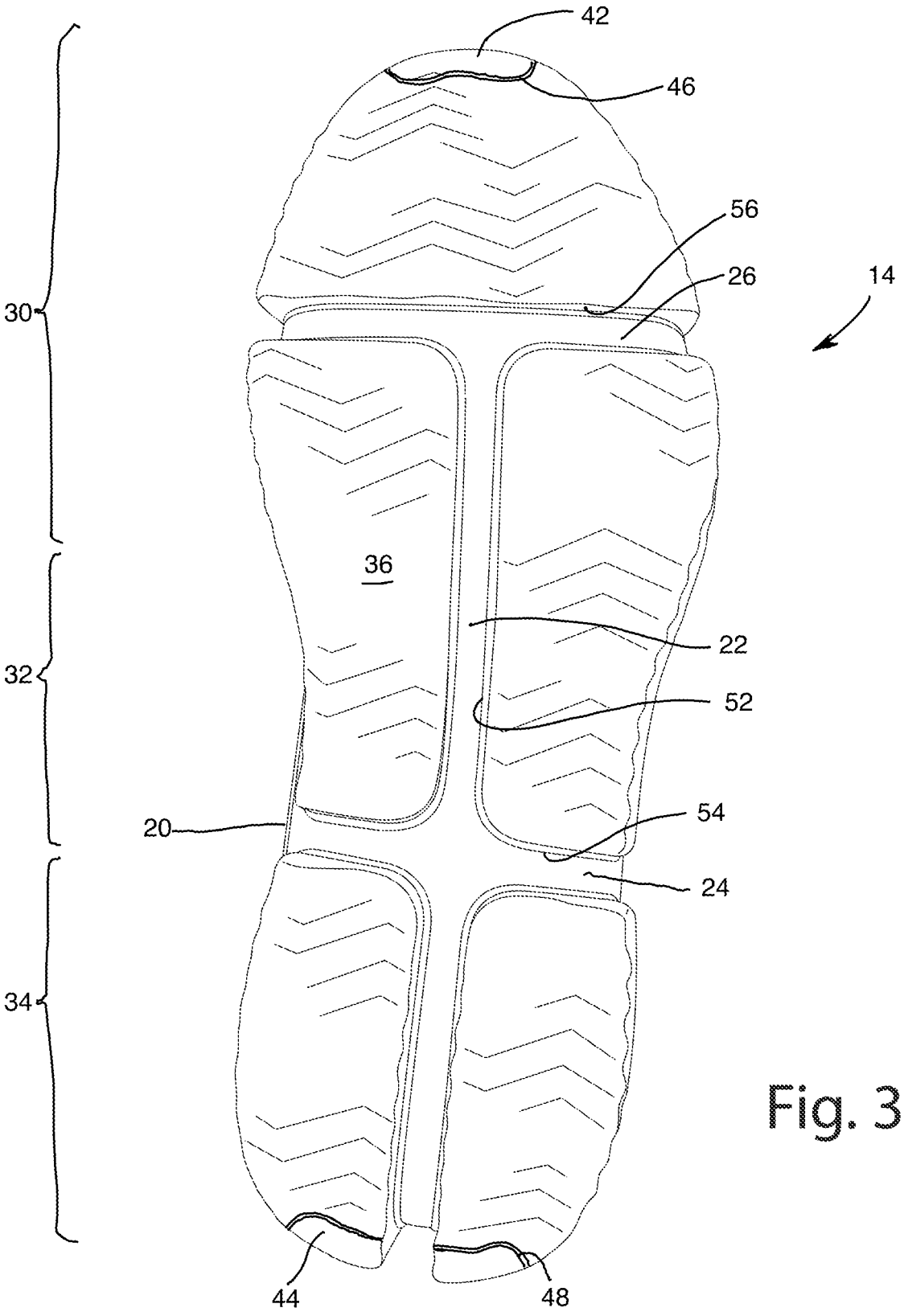
FIG. 3 is a bottom plan view of the sole assembly.

Additionally, as used herein, the term "arch section" (or midfoot section or arch) refers generally to the portion of the footwear or sole corresponding to the arch or midfoot of the wearer's foot; the term "forefoot section" (or forefoot) refers generally to the portion of the footwear forward of the arch section corresponding to the forefoot (for example, including the ball and the toes) of a wearer's foot; and the term "heel section" (or heel) refers generally to that portion of the footwear rearward of the arch section corresponding to the heel of the wearer's foot. For example, the sole assembly 14 can include a forefoot section 30, an arch or midfoot section 32 and a heel section 34, generally identified in FIG. 3. Delineation of these regions 30-34 may vary depending upon the configuration of the sole assembly 14 and/or footwear 10.

The sole assembly 14 may be joined to the upper 12 using essentially any type of footwear construction, such as a cemented construction, a direct-attach construction (e.g. direct injection molding), a Strobel-stitched construction, a stitchdown construction, a McKay stich construction, a California construction, a force-lasted construction, a slip-lasted construction, a moccasin construction, a direct vulcanizing construction or a welted construction (e.g. Goodyear welt or Blake welt). The upper 12 may be configured to implement the desired footwear construction. For example, the bottom of the upper 12 may be closed with a Strobel-board to implement a Strobel-stitched construction or with an insole board to implement a direct-attached or welted construction.

Optionally, although not shown, the footwear 10 can be constructed to include a knitted upper 12, constructed for example by weaving or knitting techniques, such as circular knitting, flat knitting, Jacquard knitting or other types of knitting. The joining of the sole assembly 14 and the knitted upper 12 can be accomplished using adhesives, cement, injection molding, pour molding, or any other technique used to join a knitted upper and sole. Of course, the footwear 10 can be provided with any other type or style of upper construction capable of being suitably joined with the sole assembly 14.

Figure 2A:
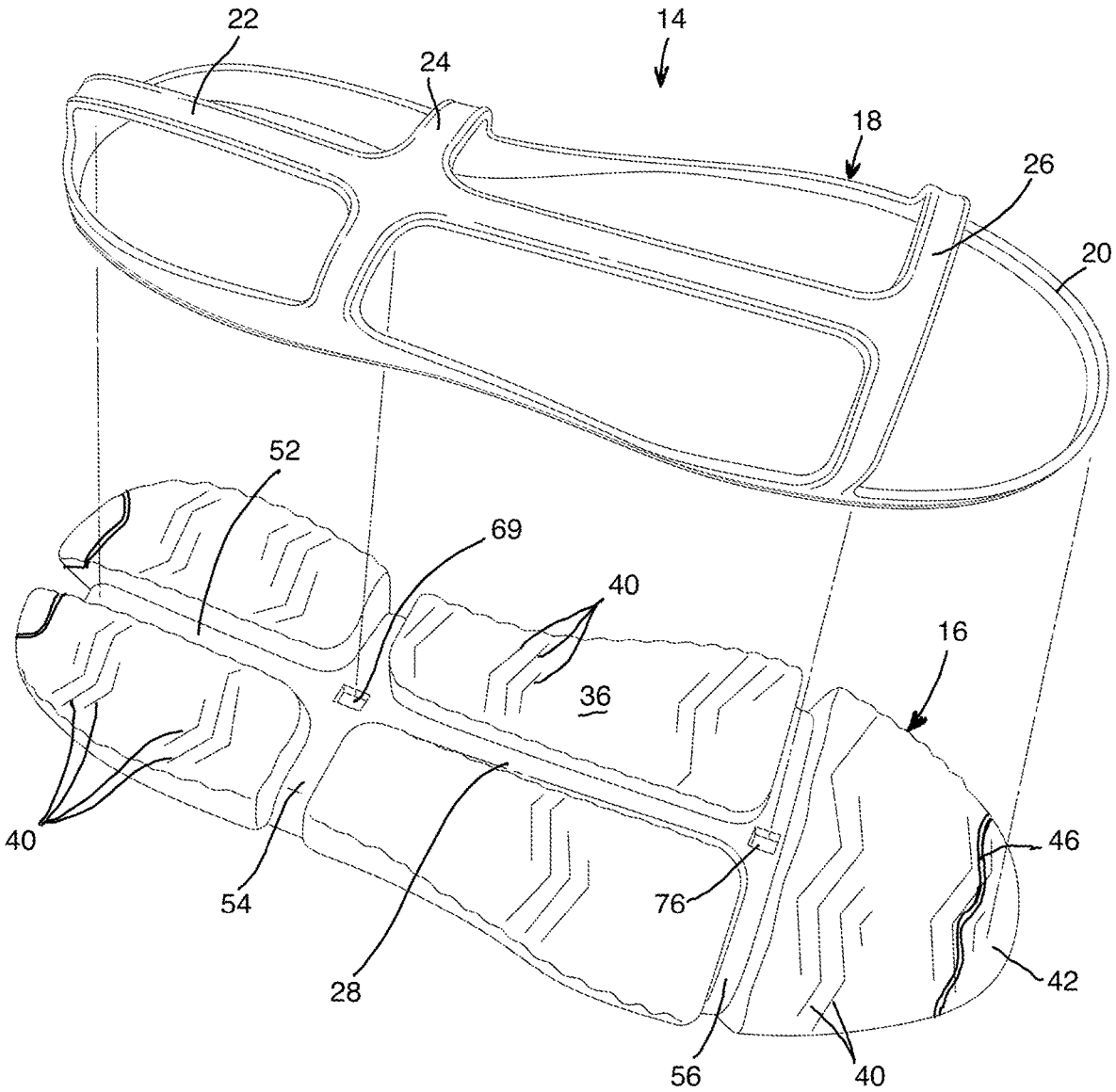
FIG. 2A is a bottom exploded perspective view of the sole assembly.
Figure 2B:
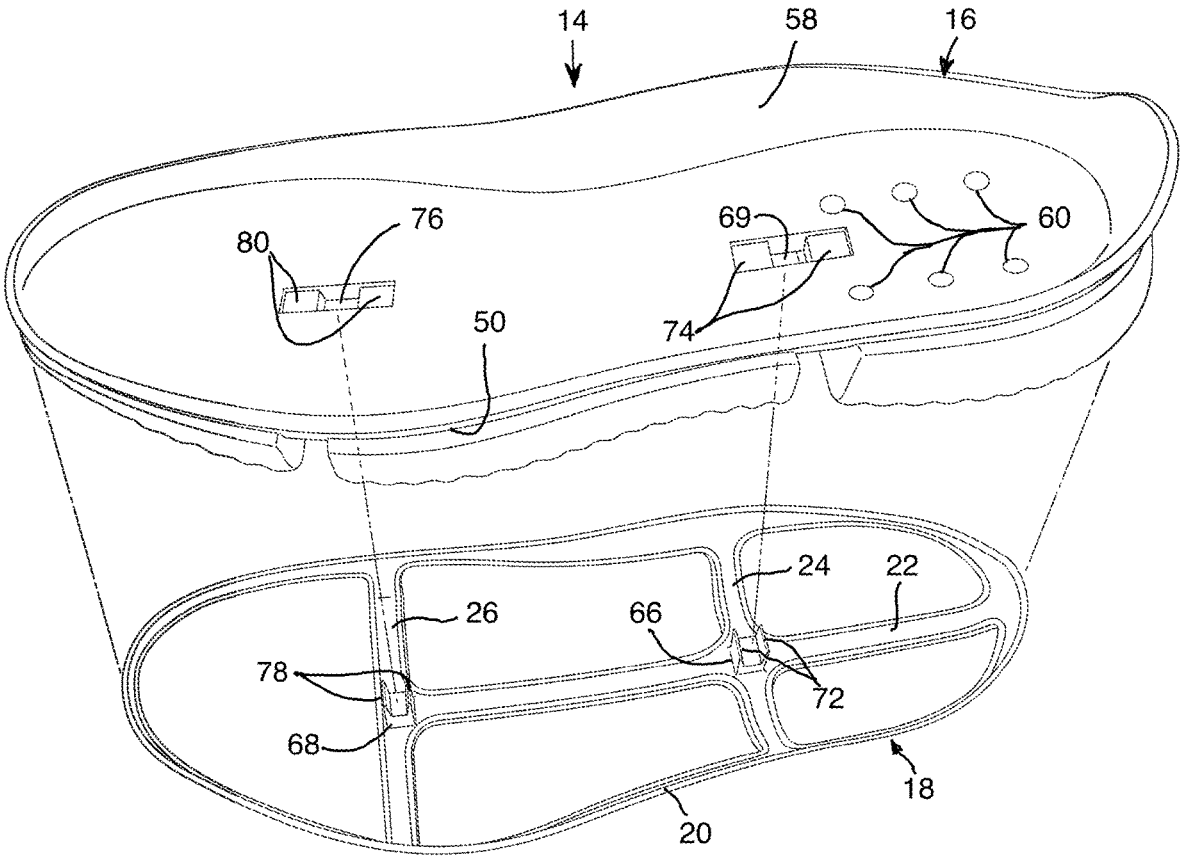
FIG. 2B is a top exploded perspective view of the sole assembly.

As noted above, the sole assembly 14 generally includes a cushioning sole 16 and a support frame 18. In the illustrated embodiment, the cushioning sole 16 underlies the upper 12 along its full length extend from heel to toe and from lateral to medial sides of the footwear 10. The cushioning sole 16 of this embodiment includes a bottom surface that forms the primary ground-engaging surface 36 and a top surface 38 that is joined to the undersurface of the upper 12. The ground-engaging surface 36 may be shaped to define a plurality of treads, lugs or other ground engaging features. As perhaps best shown in FIG. 1, the ground-engaging surface 36 of the illustrated embodiment includes a plurality of generally linear treads 40 that zigzag across the sole assembly 14 from lateral side to medial side. In this embodiment, the treads 40 are arranged in a repeating pattern of parallel lines. For ease of illustration, the treads 40 are only illustrated on portions of the ground-engaging surface 36, but it should be understood that, in this embodiment, the treads 40 cover the entire ground-engaging surface 36. The number, size, shape, arrangement and configuration of treads may vary from application to application. The exterior surface of the cushioning sole 16 may be textured for functional and/or aesthetic purposes. For example, in the illustrated embodiment, the ground engaging surface 36 of the illustrated embodiment is textured with a fine stippling pattern to provide improved traction, and the sidewall of the cushioning sole 16 above the treads 40 is generally smooth. The surface treatment of the illustrated cushioning sole 16 is merely exemplary and may vary from application to application. The top surface 38 of the cushioning sole 16 may be configured to interface with the bottom of the upper 12. For example, as shown in FIG. 2B, the top surface 38 may be somewhat cup-shaped with a sidewall 58 that extends upwardly around the perimeter of the cushioning sole 16. The top surface 38 may include a smooth curved transition to the uppermost extent of the sidewall 58. The curved transition may correspond in shape with the bottom of a typical foot, which may help to seat and comfortably retain the wearer's foot on the sole assembly 14. The cushioning sole 16 may include one or more holes, voids or other perforations intended to provide regional tuning of the cushioning properties of the cushioning sole 16. For example, in the illustrated embodiment, the cushioning sole 16 defines a plurality of circular holes 60 in the heel region. The circular holes 60 of the illustrated embodiment extend down from the top surface 38, and the removal of material results in a softening of the cushioning sole 16 in the heel region.

The cushioning sole 16 can be constructed from a material having a density that is generally less dense than the material from which the support frame 18 is constructed. The cushioning sole 16 material can have a density that allows it to compress relatively easily to provide cushion to the wearer's foot. The cushioning sole 16 can be constructed from ethylene-vinyl acetate (EVA), polyurethane, latex, foam, a gel, or other materials, including, but not limited to, EVA foam or polyurethane foam, or any of the other materials as described below and suitable for additive manufacturing processes. In the illustrated embodiment, the cushioning sole 16 is injection molded from EVA (IMEVA) and has an Asker Hardness (Durometer) of 55+/−3 on the Asker C scale. In alternative embodiments, the cushioning sole 16 may have an Asker Hardness in the range of 50 to 60 on the Asker C scale, 45 to 65 on the Asker C scale or 40 to 70 on the Asker C scale.

In this embodiment, the cushioning sole 16 includes a toe insert 42 and a heel insert 44 that provide the sole assembly 14 with enhanced resistance to wear at the toe and heal of the cushioning sole 16. As shown, the toe insert 42 and heel insert 44 may be generally arcuate portions of a sheet material that is substantially more resistant to wear than the material of the cushioning sole 16. For example, the toe insert 42 and heel insert 44 may be manufactured from TPU or rubber. In this embodiment, the ground-engaging surface 36 defines a toe insert recess 46 and heel insert recess 48. The illustrated toe insert 42 is affixed to the cushioning sole 16 in the toe insert recess 46. For example, the toe insert 42 may be adhesively secured to the cushioning sole 16. Similarly, the heel insert 44 is affixed to the cushioning sole 16 in the heel insert recess 48, for example, by adhesive. The depths of the toe insert recess 46 and the heel insert recess 48 are selected so that the toe insert 42 and heel insert 44 are substantially flush or even with the ground-engaging surface 36. In alternative embodiments, the toe insert 42 and heel insert 44 may be slightly proud or slightly recessed with respect to the ground-engaging surface 36. The bottom surfaces of the toe insert 42 and heel insert 44 may include treads, lugs or other ground-engaging features and may include texturing or other surface treatments. For example, in the illustrated embodiment, the bottom surfaces of the toe insert 42 and the heel insert 44 have tread patterns and texturing that corresponds with the ground-engaging surface 36. In alternative embodiments, the number, size, shape, arrangement and configuration of wear inserts may vary from application to application. To illustrate, additional inserts may be provided to enhance wear resistance in additional regions of the ground-engaging surface 36, or the size and/or shape of the toe insert 42/heel insert 44 may be varied from application to application to match the anticipated wear profile of each specific article of footwear. In the illustrated embodiment, a narrow groove is defined between the edges of the toe and heel inserts and the adjacent portions of the cushioning sole 16. The grooves facilitate movement of the toe and heel inserts relatively to the cushioning sole 16 as the sole assembly 14 flexes and bends during use.

The cushioning sole 16 is configured to receive the support frame 18. In this embodiment, the cushioning sole 16 includes a support frame recess 28 configured to seat the support frame 18. As perhaps best shown in FIGS. 2A and 3, the frame recess 28 includes a plurality of channels formed into the exterior surface of the cushioning sole 16. In this embodiment, the channels correspond in size, shape and arrangement with the support frame 18 so that the frame recess 28 closely receives and seats the support frame 18. The number, size, shape, arrangement and configuration of the channels in the support frame 18 may vary from application to application, for example, to correspond with variations in the support frame 18. In the illustrated embodiment, the frame recess 28 generally includes a perimeter channel 50, a longitudinal channel 52, a rear lateral channel 54 and a forward lateral channel 56. The perimeter channel 50 extends around the periphery of the cushioning sole 16 near the uppermost edge of the sidewall 58. The size, shape and depth of the perimeter channel 50 are, in this embodiment, to closely follow the shape of the perimeter member 20 of the support frame 18 and to recess the perimeter member 20 into the cushioning sole 16. The size, shape and depth of the perimeter channel 50 may vary from application to application, for example, to correspond with alternative perimeter members.

The longitudinal channel 52 of the illustrated embodiment extends from the heel to the forefoot providing a space to receive the longitudinal member 22 of the support frame 18. As shown in FIG. 1, the illustrated longitudinal channel 52 begins at the perimeter channel 50 and extends forwardly to the forward lateral channel 56. The size, shape and depth of the longitudinal channel 52 are, in this embodiment, selected to closely follow the shape of the longitudinal member 22 of the support frame 18 and to recess the longitudinal member 22 into the cushioning sole 16. The size, shape and depth of the longitudinal channel 52 may vary from application to application, for example, to correspond with alternative longitudinal members.

The rear lateral channel 54 of the illustrated embodiment extends laterally across the cushioning sole 16 in the heel or arch region to provide a space to receive the rear lateral member 24 of the support frame 18. The rear lateral channel 54 extends laterally from the perimeter channel 50 on the lateral side of the cushioning sole 16 to the perimeter channel 50 on the medial side. The size, shape and depth of the rear lateral channel 54 are, in this embodiment, selected to closely follow the shape of the rear lateral member 24 of the support frame 18 and to recess the rear lateral member 24 into the cushioning sole 16. The size, shape and depth of the rear lateral channel 54 may vary from application to application, for example, to correspond with alternative rear lateral members.

The forward lateral channel 56 of the illustrated embodiment extends laterally across the cushioning sole 16 in the forefoot region to provide a space to receive the forward lateral member 26 of the support frame 18. The forward lateral channel 56 extends laterally from the perimeter channel 50 on the lateral side of the cushioning sole 16 to the perimeter channel 50 on the medial side. The size, shape and depth of the forward lateral channel 56 are, in this embodiment, selected to closely follow the shape of the forward lateral member 26 of the support frame 18 and to recess the forward lateral member 26 into the cushioning sole 16. The size, shape and depth of the forward lateral channel 56 may vary from application to application, for example, to correspond with alternative forward lateral members.

In addition to providing a seat for the support frame 18, the channels of the frame recess 28 can help control bending/flexing of the cushioning sole 16 and assist in tuning the cushioning properties of the sole assembly 14. For example, the lateral channels 54 and 56 provide reduced thickness regions at locations where it is desirable for the sole assembly 14 to have enhanced flexibility. More specifically, the rear lateral channel 54 allows the cushioning sole 16 to flex and bend more readily just forward of the heel region or just rearwardly of the arch region, and the forward lateral channel 56 allows the cushioning sole 16 to flex and bend more readily along a line passing under the metatarsal heads of the wearer's foot. The channels 54 and 56 also affect the cushioning properties of the sole assembly 14. For example, the channels provide voids making it easier for the cushioning sole 16 to compress under load. Further, the channels provide spaces into which adjacent cushioning sole material can move as the sole assembly 14 compresses under load. To illustrate, the longitudinal channel 52 and the rear lateral channel 54 cooperatively divide the heel region of the cushioning sole 16 into two heel pods (e.g. a lateral heel pod and a medial heel pod) that are able to compress and bend on a largely independent basis. Similarly, the longitudinal channel 52 cooperates with the rear lateral channel 54 and the forward later channel 56 to define two midfoot pods (e.g. a lateral midfoot pod and a medial midfoot pod) that are capable of compressing and bending on a largely independent basis. The forward lateral channel 56 also defines a toe pod that is capable of compressing and bending largely independently of the other pods.

As can be seen, the support frame recess 28 is configured to correspond with the support frame 18. In applications that include an alternative support frame, the support frame recess may be varied to match with the alternative support frame 18. For example, if an alternative support frame includes additional and/or alternative support members, the frame recess may include additional and/or alternative channels configured to receive and retain the additional and/or alternative support members. As another example, the depth at which the support frame 18 is seated within the cushioning sole 16 may from region to region of the sole assembly 14 or from application to application. For example, in the illustrated embodiment, the support recess 28 is recessed deeper into the bottom surface 36 in the heel region than in the forefoot region. Varying the depth of the support frame 18 can be used to tune the cushioning properties of the sole assembly 14. For example, recessing the support frame 18 to a greater depth allows more of the cushioning sole 16 to protrude below and compress before more direct engagement with the support frame 18.

In the illustrated embodiment, the cushioning sole 16 is a single, one-piece component. In alternative embodiments, the cushioning sole 16 can be manufactured from a plurality of discrete segments. For example, the cushioning sole 16 may by manufactured from two separately formed parts, such as a forefoot part that extends through the forefoot region of the sole assembly 14 and a heel part that extends through the heel portion of the sole assembly 14. The number, size, shape and arrangement of cushioning sole parts may vary from application to application.

As discussed above, the support frame 18 is fitted onto the cushioning sole 16 to provide selective support for the sole assembly 14. The support frame 18 is configured with a plurality of interconnected support members arranged in a network that is configured to provide the cushioning sole 16. The support frame 18 of the illustrated embodiment generally includes a perimeter member 20, a longitudinal member 22, a rear lateral member 24 and a forward lateral member 26. In the illustrated embodiment, the perimeter member 20 extends entirely around the perimeter of the sidewall 58 of the cushioning sole 16. As shown, the perimeter member 20 is disposed adjacent to the uppermost extend of the sidewall 58 in the perimeter channel 50. The upper edge of the perimeter member 20 may be configured to be offset from and follow the shape of the uppermost edge of the sidewall 58 while the bottom edge may be configured to be offset from and follow the profile of the ground-engaging surface.

The longitudinal member 22 is configured to provide the sole assembly 14 with supplemental support in the longitudinal direction. In the illustrated embodiment, the longitudinal member 22 extends from the perimeter member 20 at the heel of the sole assembly 14 through the rear lateral member 24 and terminates at the forward lateral member 26. The longitudinal member 22 of this embodiment is configured to extend approximately along the bottom center of the cushioning sole 16, but it may be offset from the center if desired. The longitudinal member 22 vary from application to application. For example, the position and extent of the longitudinal member may vary. In alternative embodiments, the longitudinal member 22 may extend forwardly to the perimeter member 20 at the toe of the sole assembly 14. As another example, the longitudinal member 22 may start at the rear lateral member 24 and extend forwardly to the forward lateral member 26 or to the perimeter member 20 at the toe. In other alternative embodiments, the longitudinal member 22 may include separate segments, such as a rear segment starting at the perimeter member 20 in the heel and extending to the rear lateral member 24 and a forward segment starting at the forward lateral member 26 and extending forwardly to the perimeter member 20 at the toe. In alternative embodiments that include additional and/or alternative lateral members, the longitudinal member may include one or more segments that extend between the perimeter member and/or the lateral members.

As noted above, the support frame 18 includes one or more lateral members 24 and 26 that are configured to provide supplemental lateral support at in select regions of the sole assembly 14. In this embodiment, the support frame 18 includes two lateral support members, including the rear lateral member 24 and the forward lateral member 26. However, the number and location of lateral members may vary from application to application. In the illustrated embodiment, the rear lateral member 24 is configured to extend laterally across the cushioning sole 16 at the forward extent of the heel region or the rear extent of the arch region. In this embodiment, the rear lateral member 24 is configured to provide supplemental support in the arch region of the sole assembly 14. As shown, the rear lateral member 24 extends between the perimeter member 20 on the medial side and the perimeter member 20 on the lateral side. The rear lateral member 24 extends substantially perpendicular to the longitudinal member 22, but its orientation may vary. In the illustrated embodiment, the forward lateral member 26 is configured to extend laterally across the cushioning sole 16 in the forefoot region. For example, the forward lateral member 26 may extend laterally across the forefoot region in approximate alignment with the metatarsal heads of the wearer's foot. The forward lateral member 26 is configured to provide supplemental support across the forefoot. As shown in FIGS. 2A and 2B, the forward lateral member 26 extends between the perimeter member 20 on the medial side and the perimeter member 20 on the lateral side. The forward lateral member 26 extends substantially perpendicular to the longitudinal member 22, but its orientation may vary.

Figure 4:
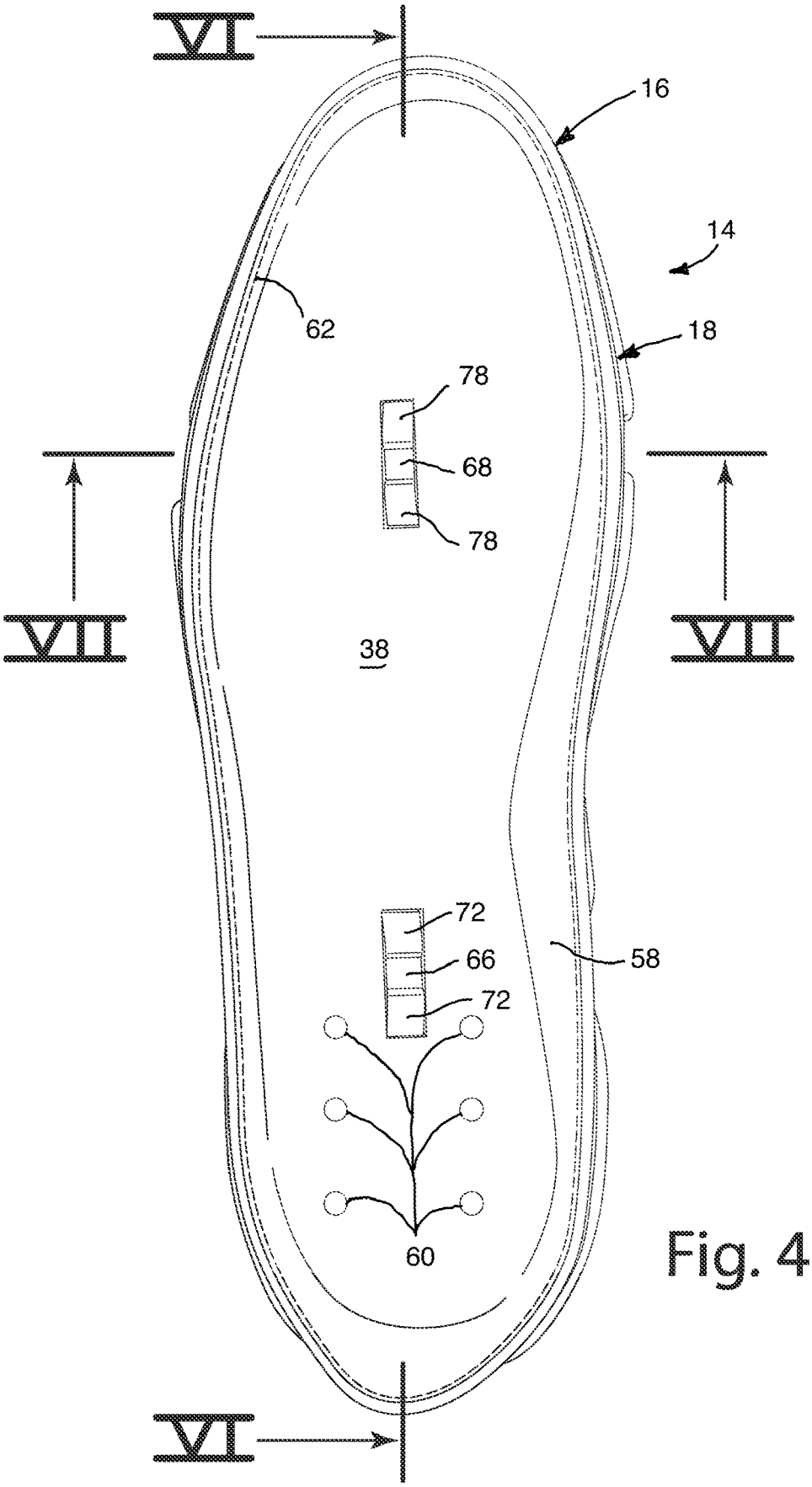
FIG. 4 is a top plan view of the sole assembly.
Figure 5:
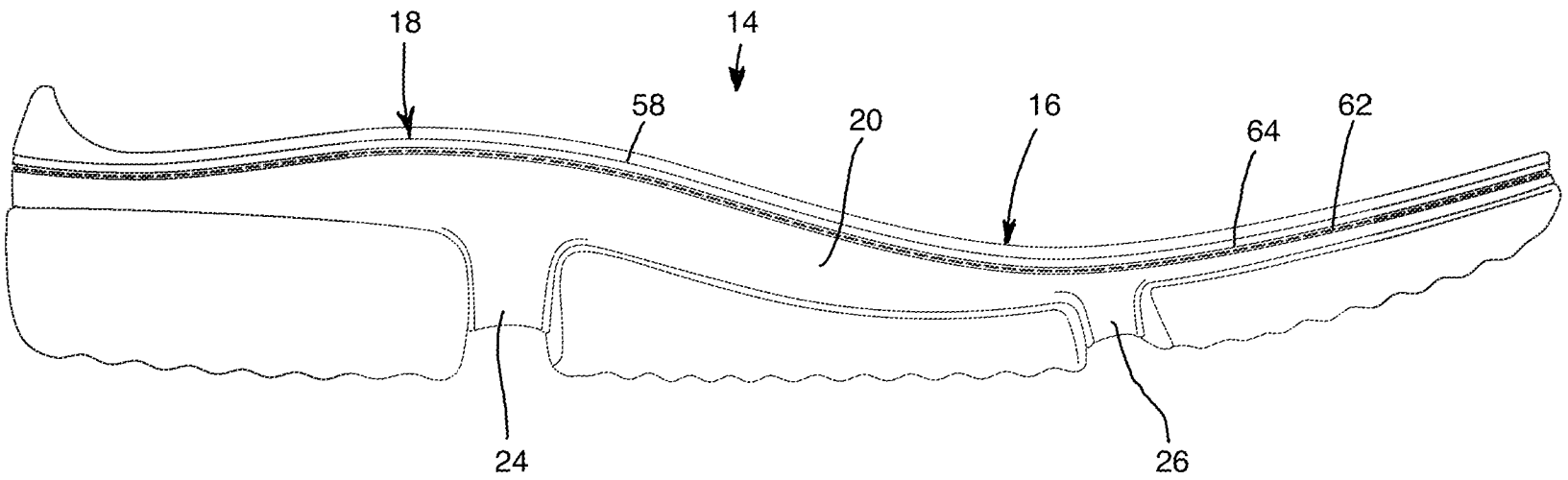
FIG. 5 is a right side view of the sole assembly.
Figure 6:
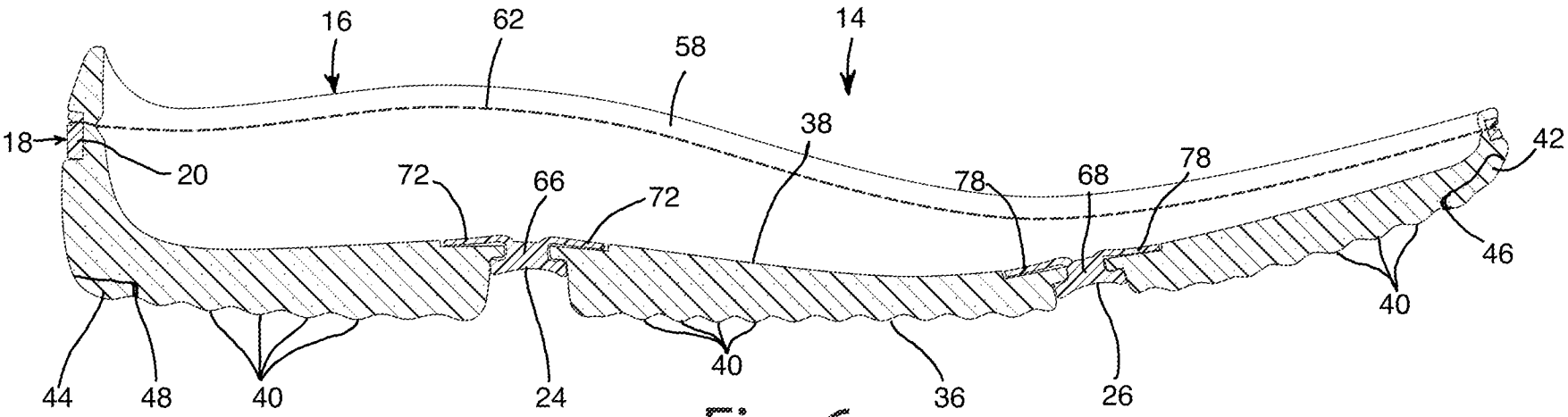
FIG. 6 is a cross sectional view of the sole assembly taken along line VI-VI of FIG. 4.
Figure 7:
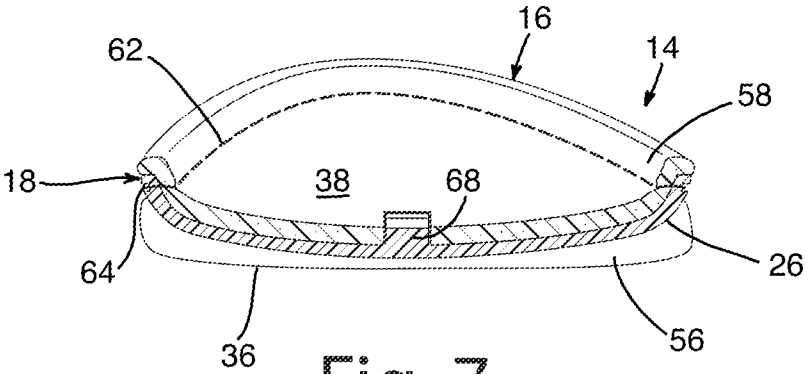
FIG. 7 is a cross sectional view of the sole assembly taken along line VII-VII of FIG. 4.

The support frame 18 is affixed directly to the cushioning sole 16. In the illustrated embodiment, the support frame 18 is joined to the cushioning sole 16 using a number of different attachments. As shown in FIGS. 6 and 7, the support frame 18 can be cemented or otherwise adhered to the cushioning sole 16. In this embodiment, a layer of cement or other adhesive is applied over all places where the support frame 18 and the cushioning sole 16 contact one another. The support frame 18 may also be stitched to the cushioning sole 16. For example, a line of stitching 62 may be formed around the sole assembly 14 joining the perimeter member 20 to the sidewall 58. In this embodiment, the perimeter member 20 includes a stitch groove 64 that receives the line of stitching 62 The stitch groove 64 recesses the line of stitching 62 inwardly from the face of the perimeter member 20, thereby protecting the line of stitching 62, for example, from abrasion and other damage. In the illustrated embodiment, the support frame 18 is also joined to the cushioning sole 16 by posts that extend through the cushioning sole 16. Referring now to FIG. 2B, the support frame 18 of the illustrated embodiment includes a rear post 66 and a forward post 68. The rear post 66 extends upwardly from support frame 18 at the intersection of the longitudinal member 22 and the rear member 24. The rear post 66 extends through a corresponding through-hole 69 in the cushioning sole 16. The upper end of the rear post 66 includes features configured to be cemented or otherwise joined to the top surface 38 of the cushioning sole 16. For example, in the illustrated embodiment, the upper end of the rear post 66 includes a pair of flaps 72 that are capable of being folded down against and cemented to the top surface 38 (See FIG. 4). In the illustrated embodiment, the top surface 38 defines recesses 74 configured to receive and seat the flaps 72 so that the secured flaps 72 are flush with the top surface 38. Similarly, the forward post 68 extends upwardly from the support frame 18 at the intersection of the longitudinal member 22 and the forward lateral member 26. As with the rear post 66, the forward post 68 extends through a corresponding through-hole 76 in the cushioning sole 16. The upper end of the forward post 68 includes features configured to be cemented or otherwise joined to the top surface 38 of the cushioning sole 16. In the illustrated embodiment, the upper end of the forward post 68 includes a pair of flaps 78 that are capable of being cemented down onto the top surface 38. In the illustrated embodiment, the top surface 38 defines recesses 80 configured to receive and seat the flaps 72 so that the secured flaps 72 are flush with the top surface 38.

The support frame 18 can be constructed from one or more materials, such as thermoplastic polyurethane elastomer (TPU). Alternatively, the support frame 18 can be constructed from rubber, synthetic rubber, polyurethane (PU), ethylene-vinyl acetate (EVA), nylon, or other polymer blends that include nylon, PU, TPU, and/or EVA. These materials are merely exemplary, and the support frame 18 can be constructed from essentially any relatively hard polymer, elastomer and/or natural or synthetic rubber or other materials capable of providing the desired functional characteristics. The support frame 18 also can be constructed to include thermoplastic elastomers and/or thermoset elastomers. Other materials such as fiber-reinforced polymers can be used. These can include epoxy, polyethylene, polyester, thermosetting plastic reinforced with carbon, glass, and/or aramid fibers. In the illustrated embodiment, the support frame 18 is injection molded from TPU and has an Asker Hardness (Durometer) of 85+/−3 on the Asker C scale. In alternative embodiments, the support frame 18 may have an Asker Hardness in the range of 80 to 90 on the Asker C scale, 75 to 55 on the Asker C scale or 70 to 100 on the Asker C scale.

In the illustrated embodiment, the support frame 18 is a single, one-piece component. In other embodiments, the support frame 18 can be manufactured from a plurality of discrete segments that are separately secured to the cushioning sole 16. For example, the support frame 18 may alternatively include two parts, such as a forefoot part that selectively supports the forefoot region of the cushioning sole 16 and a heel part that selectively supports the heel region of the cushioning sole. The number, size, shape and arrangement of support frame parts may vary from application to application.

The support frame 18 may provide structural support for the sole assembly 14 and the cushioning sole 16 in various ways that cooperate to implement the desired support profile. In the illustrated embodiment, the support members 20, 22, 24 and 26 are configured to selectively function as tension members to add structural support to the cushioning sole 16. For example, certain loads and/or certain bending/flexing movements, may cause one or more of the support members 20, 22, 24 and 26 to be placed under tension, which helps to support the cushioning sole 16 against further deformation. Additionally, the perimeter member 20 is, in the illustrated embodiment, secured around the outside of the sidewall 58. In this configuration, the perimeter member 20 helps to reinforce and add stability to the sidewall 58. This function can be enhanced by the line of stitching 62, which helps to protect against separation of the primary member 20 from the cushioning sole 16. Further, the various members 20, 22, 24 and 26 of the illustrated embodiment are adhered to the cushioning sole 16 by adhesive. The adhesive lamination of the cushioning sole 16 and the support frame 18 enhances the stability of the sole assembly 14. The number, size, shape, arrangement and configuration of support members may vary from application to application to provide tuned supplemental support.

Although the illustrated embodiment of the sole assembly 14 includes the cushioning sole 16 and the support frame 18, the present invention may be implemented in alternative embodiments with a sole assembly 14 having supplemental sole components. For example, in alternative embodiments, one or more cushioning and/or support layers may be disposed above the cushioning sole 16.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an upper adapted to receive a foot, the upper having a closed bottom and an undersurface;

a sole assembly joined to the undersurface of the upper entirely outside the closed bottom of the upper and adapted to provide a ground-engaging structure between the foot and an underlying ground surface, the sole assembly comprising:

a cushioning sole having a ground-engaging surface and a top surface, the cushioning sole disposed entirely outside the upper and not penetrating the closed bottom, the cushioning sole manufactured from a material having a first hardness;

a support frame separate from the upper fitted onto the cushioning sole, the support frame disposed outside the upper and including a plurality of support members that are recessed into the cushioning sole, the support frame manufactured from a material having a second hardness substantially greater than the first hardness; and wherein the cushioning sole defines a support frame recess including a plurality of channels each configured to receive a portion of the support frame, the support frame recess including a plurality of bottom channels extending upwardly into the ground-engaging surface along a bottom of the cushioning sole, each of the plurality of bottom channels receiving a portion of the support frame, each of plurality of bottom channels being of sufficient depth that the portion of the support frame received in that bottom channel is fully recessed within that bottom channel such that each portion of the support frame received within one of the plurality of bottom channels includes a bottom surface upwardly offset from the ground-engaging surface.

2. The article of footwear of claim 1, wherein the support frame includes a perimeter member extending entirely around the a periphery of the cushioning sole.

3. The article of footwear of claim 2 wherein the support frame includes at least one lateral member extending laterally across the cushioning sole.

4. The article of footwear of claim 2 wherein the support frame includes a rear lateral support member and a forward lateral support member.

5. The article of footwear of claim 4 wherein the sole assembly include a heel region, an arch region and a forefoot region; and wherein the rear lateral support member is disposed toward a forward extent of the heel region or a rearward extent of the arch region.

6. The article of footwear of claim 5 wherein the forward support member is disposed in the forefoot region.

7. The article of footwear of claim 6 wherein the support frame includes at least one integral post extending through the cushioning sole and being secured to the top surface of the cushioning sole, the support frame including a longitudinal member, the at least one post being disposed at the intersection of the longitudinal member and one of the rear lateral support member and the forward lateral support member.

8. The article of footwear of claim 7 further including a line of stitching joining the support frame to the cushioning sole.

9. The article of footwear of claim 8 where the support frame is adhered to the cushioning sole by an adhesive.

10. The article of footwear of claim 6 wherein the support frame includes a longitudinal member.

11. The article of footwear of claim 10 wherein the longitudinal member extends from the perimeter member through the rear lateral member to the forward lateral member.

12. The article of footwear of claim 11 wherein the support frame includes a rear post and a forward post, the rear post disposed at the intersection of the rear lateral member and the longitudinal member, the forward post disposed at the intersection of the forward lateral member and the longitudinal member.

13. A sole assembly for an article of footwear having an upper with a closed bottom comprising:

a cushioning sole, the cushioning sole having a bottom ground-engaging surface and a top surface configured to be attached to the upper, the cushioning sole being disposed entirely outside the upper, the cushioning sole manufactured from a material having a first hardness; and a support frame separate from the upper fitted onto the cushioning sole, the support frame including a plurality of support members recessed into the cushioning sole, the support frame manufactured from a material having a second hardness substantially greater than the first hardness; and wherein the cushioning sole defines a support frame recess including a plurality of channels each configured to receive a portion of the support frame, the support frame recess including a plurality of bottom channels extending upwardly into the ground-engaging surface along a bottom of the cushioning sole, each of the plurality of bottom channels receiving a portion of the support frame, each of the plurality of bottom channels being of sufficient depth that the portion of the support frame received in that bottom channel is fully recessed within that bottom channel such that each portion of the support frame received within one of the plurality of bottom channels includes a bottom surface upwardly offset from the ground-engaging surface.

14. The sole assembly of footwear of claim 13 wherein the support frame includes at least one longitudinal member and at least one lateral member.

15. The sole assembly of footwear of claim 13 wherein cushioning sole includes a sidewall extending upwardly from the top surface; and wherein the support frame includes a perimeter member extending about the sidewall.

16. The sole assembly of footwear of claim 15 wherein the support frame include a rear lateral member and forward lateral member; and wherein the longitudinal member extends from the perimeter member through the rear lateral member to the forward lateral member.

17. The sole assembly of footwear of claim 16 further including a line of stitching joining the perimeter member to the sidewall.

18. The sole assembly of footwear of claim 17 wherein the support frame includes at least one integral post extending through the cushioning sole, the post affixed to the top surface of the cushioning sole, the at least one post being disposed at the intersection of the longitudinal member and one of the rear lateral member and the forward lateral member.

* * * * *